US006884186B2

(12) United States Patent
Fluckiger et al.

(10) Patent No.: US 6,884,186 B2
(45) Date of Patent: Apr. 26, 2005

(54) GAME PROJECTILE DISPENSING DEVICE

(75) Inventors: Thomas Fluckiger, Tolland, CT (US); David Fluckiger, Tolland, CT (US); Sherwood H. Aborn, Stafford, CT (US); Scott Burnett, Windham, NH (US); John La Plante, Willington, CT (US)

(73) Assignee: PlayHard Sports, LLC, Melrose, MA (US)

( * ) Notice: Subject to any disclaimer, the term of this patent is extended or adjusted under 35 U.S.C. 154(b) by 106 days.

(21) Appl. No.: 10/280,985

(22) Filed: Oct. 25, 2002

(65) Prior Publication Data

US 2004/0082411 A1 Apr. 29, 2004

(51) Int. Cl.[7] ..... A63B 69/00; F41B 7/00; F41B 11/00

(52) U.S. Cl. ..... 473/446; 124/16; 124/81

(58) Field of Search ..... 473/417, 418, 473/422, 431, 446; 124/84, 6, 7, 56, 78, 4, 16; 221/252, 306, 298–301

(56) References Cited

U.S. PATENT DOCUMENTS 3,313,452 A 4/1967 Katz
3,665,910 A 5/1972 Boni
3,876,201 A 4/1975 King
5,069,451 A 12/1991 Martens et al.
5,511,690 A 4/1996 Calhoun et al.
5,647,338 A * 7/1997 Martin ..... 124/75
5,846,144 A 12/1998 Bothers
6,719,340 B1 * 4/2004 Imig ..... 294/19.2

* cited by examiner

*Primary Examiner*—Mitra Aryanpour
(74) *Attorney, Agent, or Firm*—O'Connell Law Firm

(57) ABSTRACT

A game projectile dispensing device with a dispensing housing, a game projectile retaining member for retaining a plurality of game projectiles in a stack, first and second game projectile emission chutes, an actuating lever with a first arm for being engaged by a player and a second arm for engaging a game projectile whereby a player can press on the first arm of the actuating lever to induce the actuating lever to drive the lower-most projectile from the stack of game projectiles. A game projectile supply ramp can enable a player to select between emitting the game projectile from the first and second game projectile emission chutes. The game projectile supply ramp can be disposed below the game projectile retaining member whereby, when driven from the stack of game projectiles, a game projectile will drop onto the game projectile supply ramp for being dispensed.

22 Claims, 6 Drawing Sheets

GAME PROJECTILE DISPENSING DEVICE

FIELD OF THE INVENTION

The present invention relates generally to dispensing arrangements. Stated more particularly, disclosed herein is a device for dispensing game projectiles to enable the practice and development of sports skills.

BACKGROUND OF THE INVENTION

The ability to play a given sport with proficiency is an integral element to a player's enjoyment and success in playing the game. Of course, it will also be appreciated that practice and skill development are inherently necessary to improving one's proficiency in any sport including, for example, hockey. Even further, one knowledgeable in the art will be well aware that skill proficiency can be achieved most readily by the efficient and constructive use of the time that is dedicated to skill practice and development. As one would expect, therefore, athletes expend significant time and effort in honing their skills. For example, hockey players engage in countless repetitions of varied types of practicing passing, receiving, handling, and shooting.

Advantageously, numerous prior art inventors and substantially innumerable coaches have contributed usefully to the present state of the art by providing drills, devices, and systems for enabling players to practice and improve their skills. For example, a number of devices have been disclosed for dispensing game projectiles, such as hockey pucks, for being handled and struck by a player. Such devices are of undeniable utility in their general ability for making game projectiles available to a user for being struck and otherwise handled.

Unfortunately, however, these devices suffer from a number of disadvantages. For example, prior art devices typically can dispense game projectiles in only one direction whereby they are suitable for players of only one type of hand dominance. Furthermore, even where the player's hand dominance corresponds to the design of the machine, the player may have difficulty practicing certain types of shots that would normally demand that the puck be dispensed from an opposite direction. By way of example, the same player may find the direction of puck dispensing to be proper when practicing slap shots but opposite to what he or she would want for practicing backhanded passes and shots. Even further, many dispensing devices of the prior art are unable to supply multiple hockey pucks or other game projectiles in a rapid and efficient manner without a need for electricity or other power.

For these and further reasons, it is clear that there is a need for a device for dispensing game projectiles that overcomes one or more of the deficiencies left by the prior art. It is still more clear that a device for dispensing game projectiles that overcomes all of the known disadvantages of the prior art while providing a plurality of heretofore unrealized advantages thereover would represent a marked advance in the art.

SUMMARY OF THE INVENTION

Advantageously, the present invention sets forth with the broadly stated object of providing a dispensing device for game projectiles that solves each of the problems left by the prior art while providing a number of heretofore unrealized advantages thereover.

Stated more particularly, one basic object of the invention is to provide a dispensing device for game projectiles that can dispense game projectiles in more than one direction.

A related object of the invention is to provide a game projectile dispensing device that can accommodate players of both hand dominances while allowing players of each hand dominance to strike projectiles with forehand and backhand striking movements.

A further object of the invention is to provide a game projectile dispensing device that can retain and dispense multiple game projectiles to enable extended practice sessions to be carried out in an efficient and convenient manner.

Yet another object of the invention is to provide a game projectile dispensing device that is durable in construction and reliable in performance.

These and further objects and advantages of the present invention will become obvious both to one who reviews the present specification and drawings and to one who has an opportunity to make use of an embodiment of the present invention.

In accomplishing the aforementioned objects, a most basic embodiment of the present invention for a game projectile dispensing device is founded on a dispensing housing with a first side and a second side. A game projectile retaining member, which can take the form of a game projectile retaining cylinder, can retain a plurality of game projectiles in a stack relative to the dispensing housing. A first game projectile emission chute can be disposed in the first side of the dispensing housing, and a second game projectile emission chute can be disposed in the second side of the dispensing housing. An actuating means, such as an actuating lever, can enable a player to cause a game projectile to be dispensed from the dispensing housing. A selection means, such as a game projectile supply ramp, can enable a player to select between emitting game projectiles through the first game projectile emission chute or through the second game projectile emission chute.

Where the selection means comprises a game projectile supply ramp, it can be tiltable from a first orientation wherein it provides a ramp sloped toward the first game projectile emission chute and a second orientation wherein it provides a ramp sloped toward the second game projectile emission chute. To accomplish this, the game projectile supply ramp can be pivotally supported by at least a first axle rod. A control knob can be operably coupled to the first axle rod so that a player can rotate the control knob in a first rotational direction to cause the game projectile supply ramp to provide a ramp sloped toward the first game projectile emission chute and in a second rotational direction to cause the game projectile supply ramp to provide a ramp sloped toward the second game projectile emission chute.

Where an actuating lever acts as the actuating means, it can be pivotable about a pivot axis and can have a first arm for being engaged by a player and a second arm for engaging a game projectile and inducing the game projectile to be dispensed from the dispensing housing. The second arm of the actuating lever can be generally L-shaped with a proximal leg of the L disposed generally perpendicularly to the first arm and a distal leg of the L disposed generally perpendicularly to the proximal leg and collinear with the first arm. The distal leg of the second arm can be disposed adjacent to the lower-most game projectile when the actuating lever is in a non-actuated orientation. Under such an arrangement, a player can press on the first arm of the actuating lever to cause it to pivot thereby inducing the distal leg of the second arm to drive the lower-most projectile from the stack of game projectiles. With this, the lower-most game projectile will be allowed to be dispensed from the dispensing housing.

Where a game projectile supply ramp acts as the selection means, it can be disposed below the means for retaining the plurality of game projectiles. With this, upon being driven from the stack of game projectiles, a game projectile will drop onto the game projectile supply ramp for being dispensed from either the first game projectile emission chute or the second game projectile emission chute, depending on the orientation of the game projectile supply ramp. Where the game projectile is a hockey puck, it can drop onto the game projectile supply ramp on its edge whereby it will roll down the ramp and through the emission chute for being struck or otherwise manipulated by a player.

The game projectile retaining member can have a body portion, a first end, a second end, and an open inner volume for retaining a plurality of game projectiles. Preferably, the game projectile retaining member will be removably and replaceably received relative to the dispensing housing. A base retainer member can be disposed at the first end of the game projectile retaining member for preventing game projectiles from being inadvertently dislodged from within its open inner volume. With this, the game projectile retaining member can be used in retrieving, retaining, storing, and dispensing game projectiles. The base retainer member can have an open mouth for allowing game projectiles to pass therethrough. Where the actuating means comprises a lever, the base retainer member can have an aperture disposed opposite to the open mouth for allowing the entry and operation of the actuating lever. Still further, a handle can be coupled to the body portion of the game projectile retaining member generally in line with the open mouth of the base retainer member for further ensuring that game projectiles do not fall during a carrying of the game projectile retaining member.

With a plurality of embodiments of the present invention for a game projectile dispensing device described, one will appreciate that the foregoing discussion broadly outlines the more important features of the invention merely to enable a better understanding of the detailed description that follows and to instill a better appreciation of the inventors' contribution to the art. Before an embodiment of the invention is explained in detail, it must be made clear that the following details of construction, descriptions of geometry, and illustrations of inventive concepts are mere examples of the many possible manifestations of the invention.

DETAILED DESCRIPTION OF PREFERRED EMBODIMENTS

As is the case with many inventions, the present invention for a game projectile dispensing device is subject to a wide variety of embodiments. However, to ensure that one skilled in the art will be able to understand and, in appropriate cases, practice the present invention, certain preferred embodiments of the broader invention revealed herein are described below and shown in the accompanying drawing figures.

Figure 1:
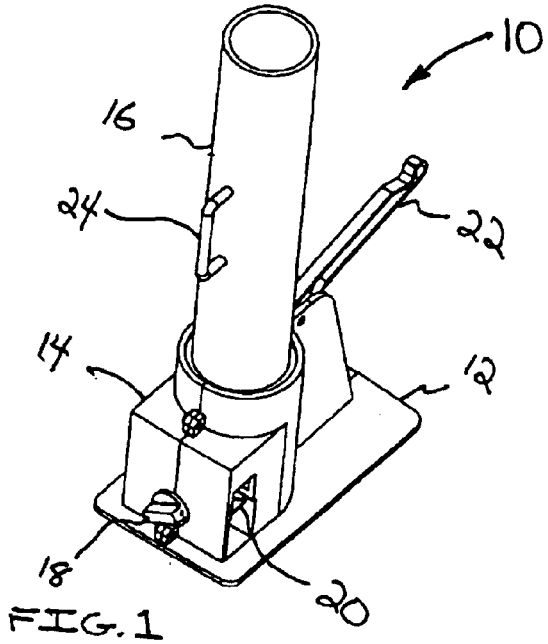
FIG. 1 is a perspective view of a game projectile dispensing device according to the present invention.

With this in mind and looking more particularly to the accompanying figures, a preferred embodiment of the game projectile dispensing device is indicated generally at 10 in FIG. 1 where the device is designed particularly for dispensing hockey pucks. There, one sees that the game projectile dispensing device 10 is founded on a flat base portion 12. A dispensing housing 14 is fixed to the base portion 12, such as by being secured thereto or by being formed integrally therewith. A game projectile retaining cylinder 16 is removably and replaceably received relative to the dispensing housing 14 and can be lifted and held by a retaining handle 24. An actuating lever 22 is pivotally retained relative to the dispensing housing 14 for dispensing game projectiles, which are not shown in this drawing, as will be discussed more fully below. Finally, a control knob 18 is rotatably retained relative to the dispensing housing 14 for controlling the supply orientation of a game projectile supply ramp 20 and thus the direction in which game projectiles are dispensed from the dispensing device 10.

Figure 2:
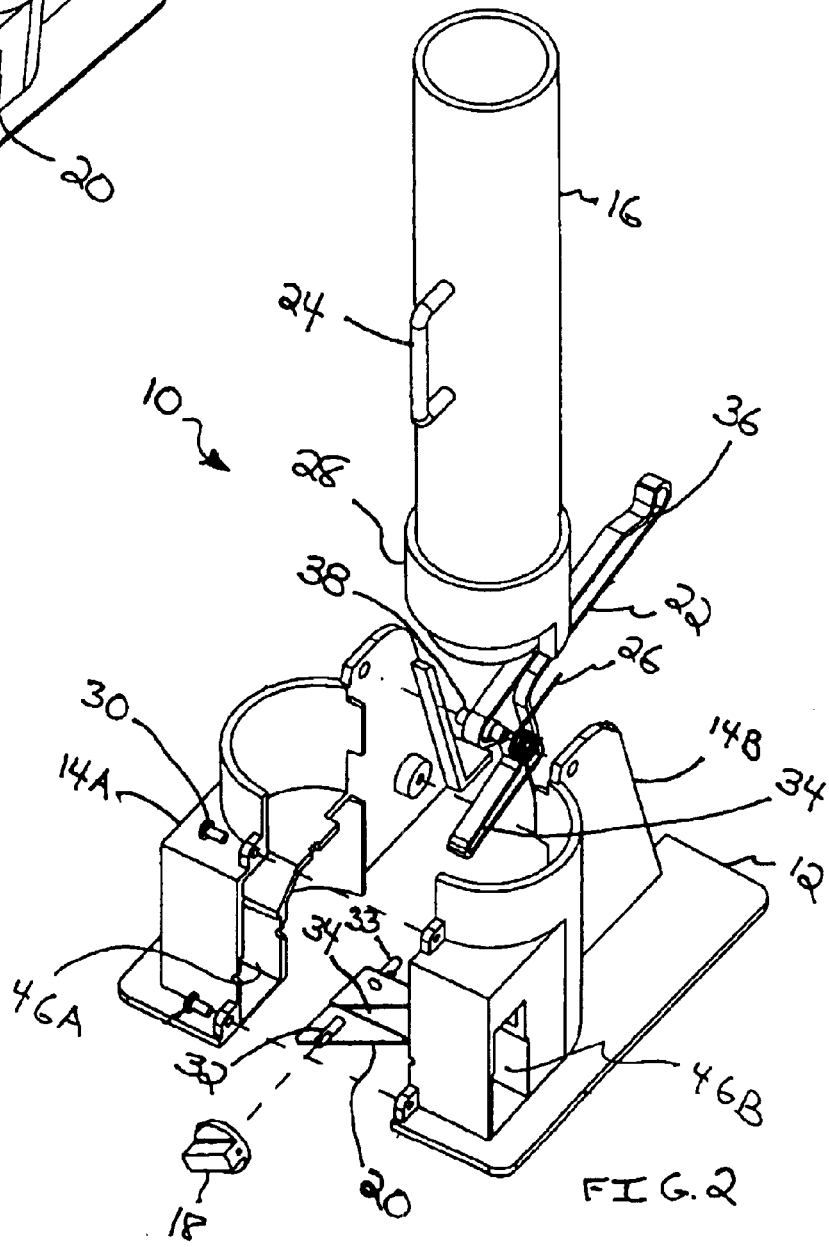
FIG. 2 is an exploded perspective view of the game projectile dispensing device of FIG. 1.
Figure 3:
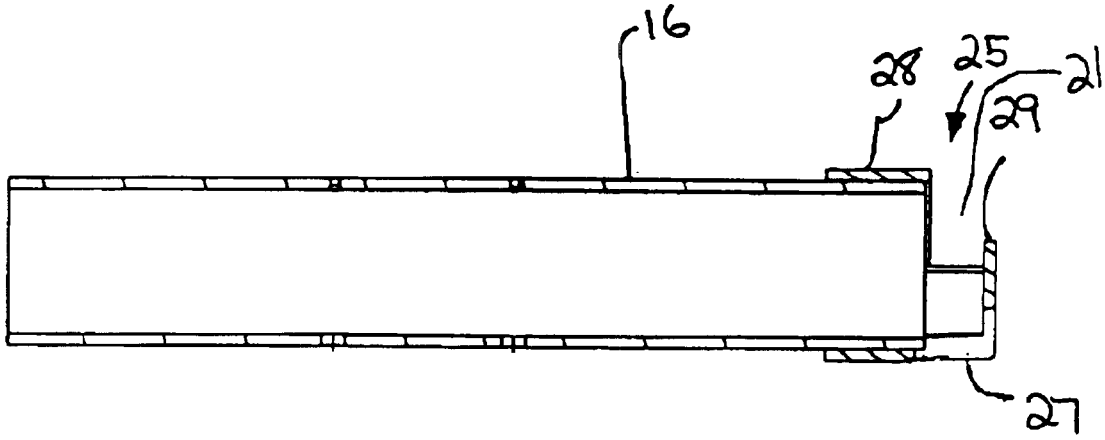
FIG. 3 is a cross sectional view of a game projectile retaining cylinder according to the present invention.
Figure 3A:
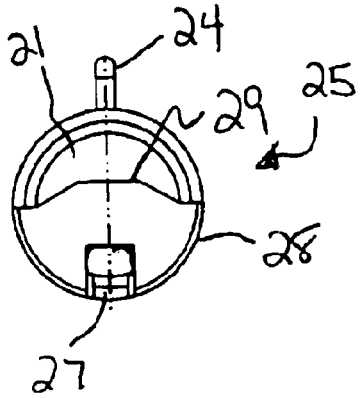
FIG. 3A is a bottom plan view of the game projectile retaining cylinder of FIG. 3.
Figure 6:
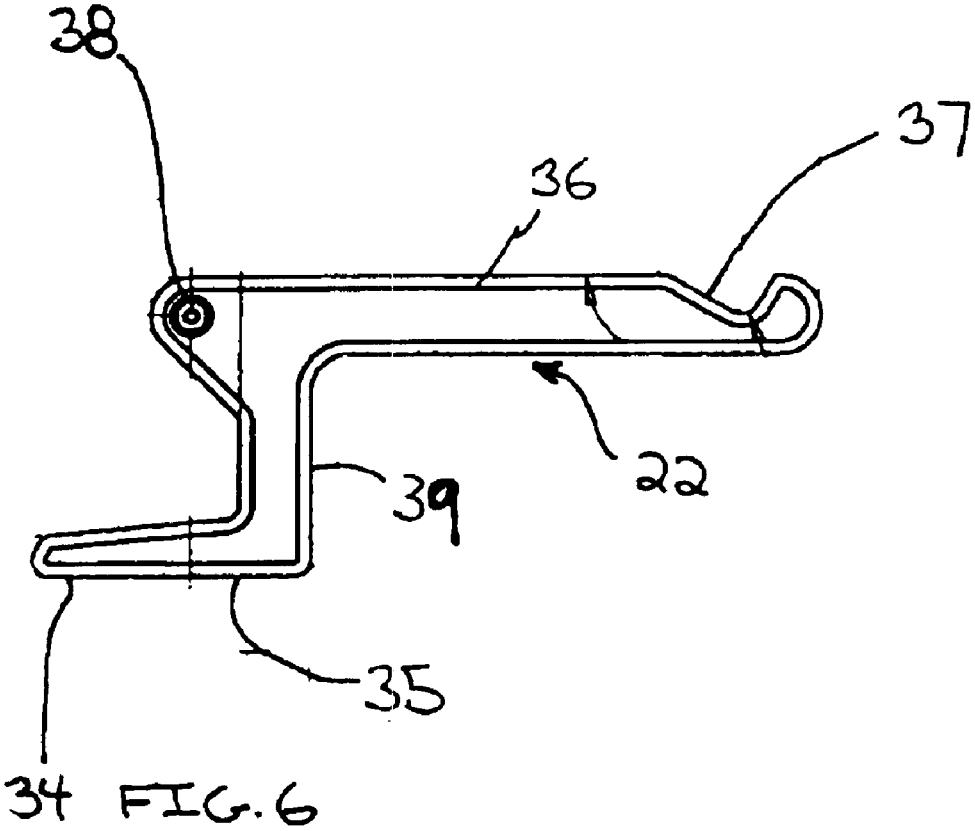
FIG. 6 is a view in side elevation of an actuating lever according to the present invention.
Figure 7A:
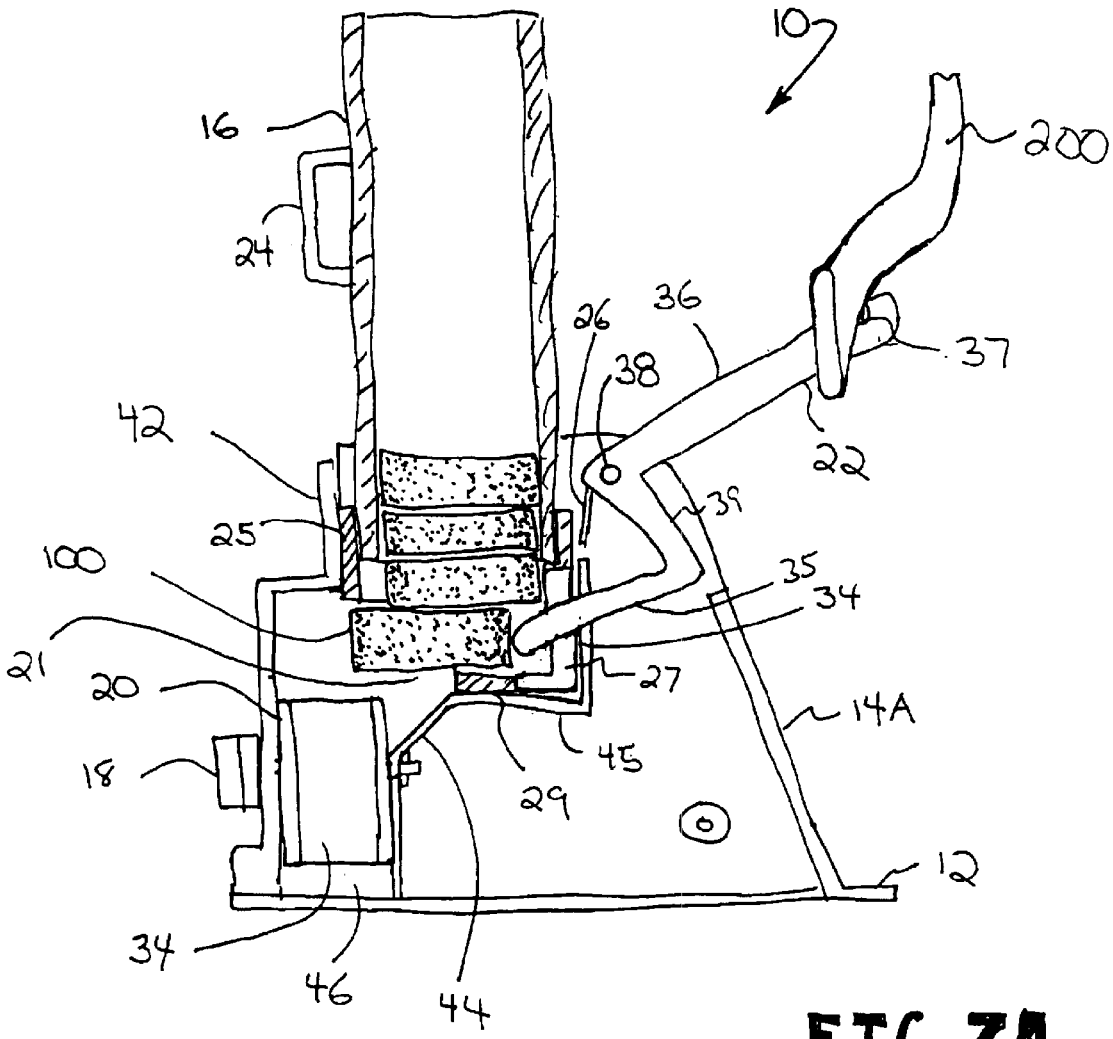
FIG. 7A is a partially dismantled and cross sectioned view in side elevation of a game projectile dispensing device according to the present invention in operation.
Figure 7B:
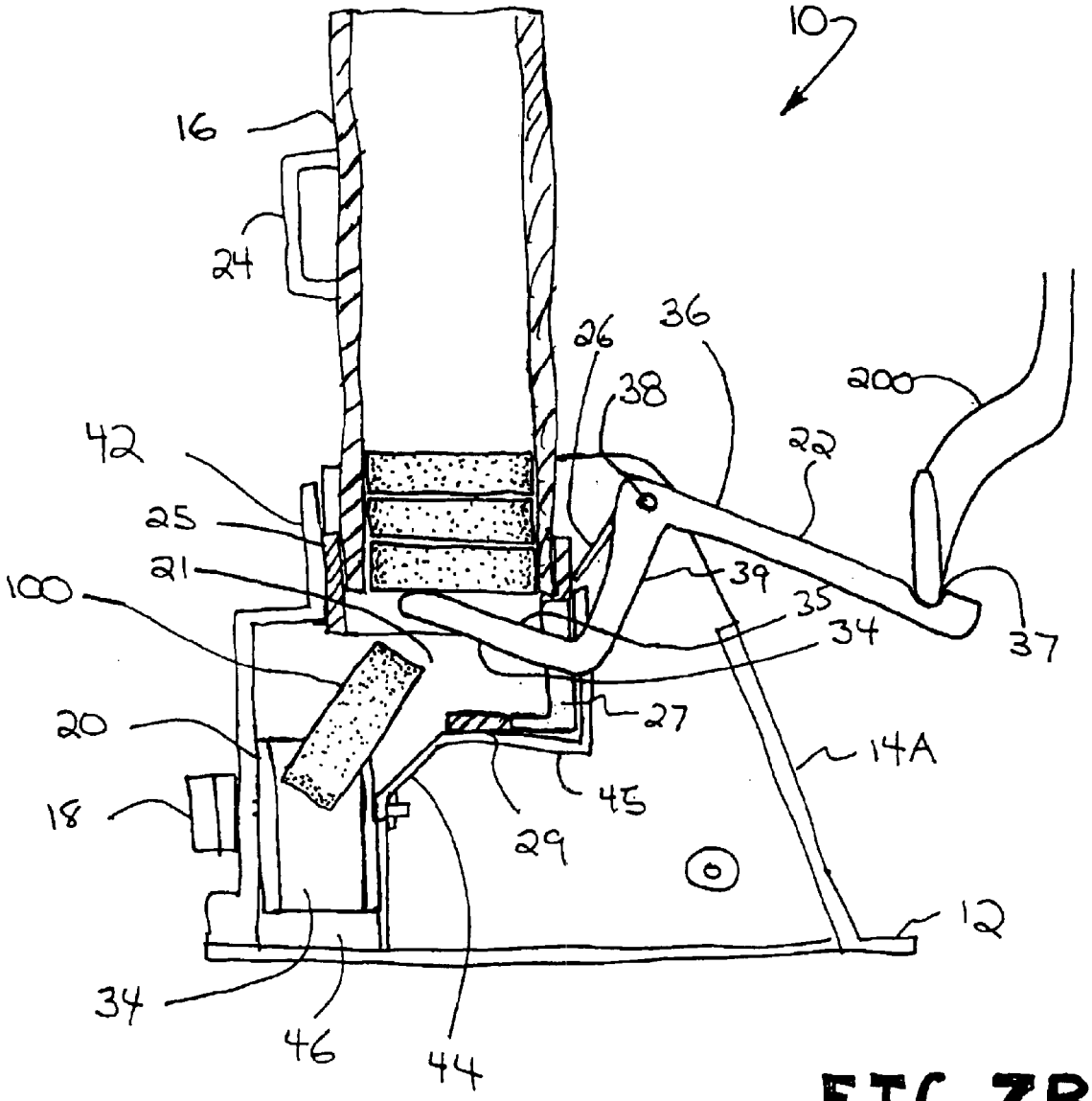
FIG. 7B is a further partially dismantled and cross sectioned view in side elevation of the game projectile dispensing device in operation.

Turning to FIG. 2, the game projectile dispensing device 10 is shown in an exploded view such that the dispensing housing 14 is shown to comprise first and second dispensing housing halves 14A and 14B that are secured together by a plurality of fasteners 30. The actuating lever 22, which is shown alone in FIG. 6, is interposed between the first and second dispensing housing halves 14A and 14B to pivot about a pivot axis 38. The actuating lever 22 is biased to the non-pivoted position depicted in FIGS. 1 and 2 by a coil spring 26. A first arm 36 of the actuating lever 22 is generally straight and projects from between the dispensing housing halves 14A and 14B. An engaging notch 37 is disposed at a distal end of the first arm 36 for engaging a striking implement 200 as is shown in FIGS. 7A and 7B. A second arm 34 of the actuating lever 22 is L-shaped with a proximal leg 39 of the L disposed generally perpendicularly to the first arm 36 and a distal leg 35 of the L disposed generally perpendicularly to the proximal leg 39 and collinear with the first arm 36.

Figure 5:
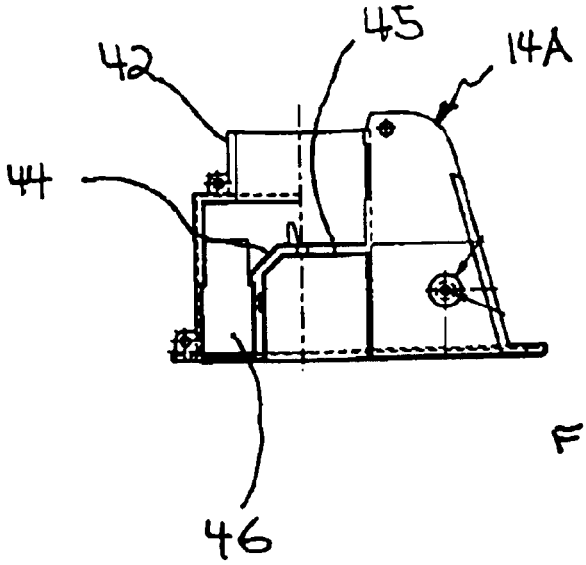
FIG. 5 is a view in side elevation of a game projectile dispensing housing half according to the present invention.

The first and second dispensing housing halves 14A and 14B are essentially identical. As FIG. 5 shows relative to the first dispensing housing half 14A, each housing half 14A has a semicircular retaining wall 42 for receiving and retaining the game projectile retaining cylinder 16. A support base 45 is fixed below the retaining wall 42 for supporting the game projectile retaining cylinder 16. An angled slide wall 44 descends from the support base 45 and leads to a game projectile emission chute 46. As FIGS. 1 and 2 show most clearly, the game projectile emission chute 46 extends entirely through each of the first and second dispensing housing halves 14A and 14B and thus entirely through the dispensing housing 14.

Figure 4:
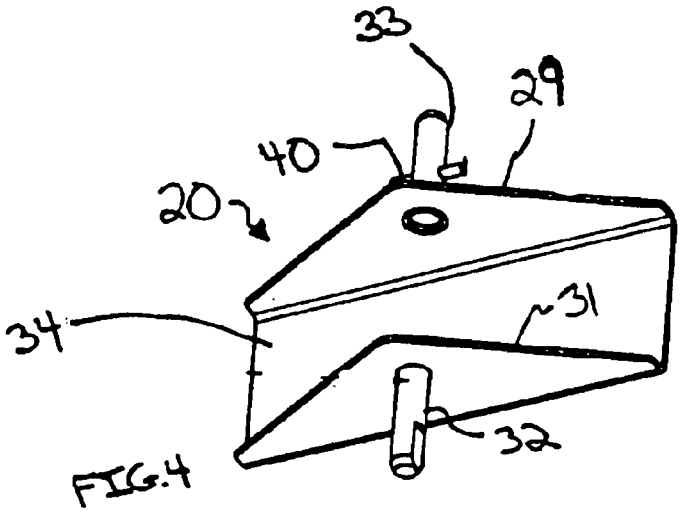
FIG. 4 is a perspective view of a game projectile supply ramp under the present invention.

By combined reference to FIGS. 1, 2, and 4, one sees that the game projectile supply ramp 20 is formed by a generally flat, rectangular base plate 34 that is fixed to first and second triangular side walls 29 and 31. A first axle rod 32 projects from a first side wall 31 while a second axle rod 33, which is coaxial with the first axle rod 32, projects from a second side wall 29. A retaining rod 40 is disposed through the second axle rod 33 while the first axle rod 32 has a flattened portion for engaging the control knob 18. When the game projectile dispensing device 10 is fully assembled, the first and second axle rods 32 and 33 are sandwiched within corresponding notches in the first and second dispensing housing halves 14A and 14B. With that, the control knob 18 can be employed to control the orientation of the game projectile supply ramp 20 such that it could provide a ramp sloped toward either the side of the first dispensing housing half 14A or toward the side of the second dispensing housing half 14B as is shown in FIGS. 1 and 2.

As shown most clearly in FIGS. 3, 3A, 7A, and 7B, the game projectile retaining cylinder 16 has a base retainer member 25 coupled to what can be considered its first or base end. The base retainer member 25 has a cylindrical sidewall 28 that entirely surrounds the base end of the game projectile retaining cylinder 16 but that becomes only semicircular where it extends beyond the base end of the game projectile retaining cylinder 16. A semicircular base plate 29 is fixed to the most distal end of the cylindrical sidewall 28. With this, an open mouth 21 is left for allowing the dispensing of game projectiles as will be discussed more fully hereinbelow. Furthermore, an aperture 27 is provided in the cylindrical sidewall 28 and the base plate 29 opposite to the open mouth 21 for allowing the entry and operation of the actuating lever 22 as will also be discussed below.

It will, of course, be appreciated that the game projectile dispensing device 10 and its constituent elements could be formed from a variety of materials and with a variety of dimensions. In this presently preferred embodiment wherein the game projectile dispensing device 10 is designed for dispensing hockey pucks 100, the first and second dispensing housing halves 14A and 14B can be formed from gray anodized aluminum such that they will demonstrate the durability required for sports related applications and so that they will resist rust and corrosion. The game projectile retaining cylinder 16 and the base retainer member 25 can each be formed from a polymer, such as polyvinylchloride or PVC, while the retaining handle 24 can be formed from a metal, such as stainless steel or aluminum. The actuating lever 22 can be crafted from a metal, such as black anodized aluminum, and the game projectile supply ramp 20 and the first and second axle rods 32 and 33 can be formed from stainless steel. The control knob 18 can be plastic.

The game projectile retaining cylinder 16 preferably will have an overall length of approximately 19 inches and an outside diameter of approximately 3.5 inches. The cylindrical sidewall 28 of the base retainer member 25 has an inside diameter of approximately 3.5 inches and an outside diameter of approximately 4 inches. The preferred game projectile supply ramp 20 can have an overall length of approximately 3 and ⅝ inches and a width of about 1 and ½ inches. The game projectile emission chute 46 can have a width of approximately 2 inches, and the angled slide wall 44 can be disposed at an angle of approximately 45 degrees from horizontal. The first arm 36 of the actuating lever 22 can have a length from the pivot axis 38 to its end of approximately 8 inches, and the engaging notch 37 can be disposed approximately 1 inch from the end of the first arm 36. The proximal leg 39 of the second arm 34 can have a length from the pivot axis 38 to its end of 3 and ⅜ inches. The distal leg 35 preferably will have a length of 3 and ½ inches while its distal tip will be laterally spaced approximately 2 inches from the pivot axis 38.

Turning to FIGS. 7A and 7B, one sees an embodiment of the game projectile dispensing device 10 in operation. There, just the first dispensing housing half 14A is shown, and the second dispensing housing half 14B is removed for clarity. A plurality of game projectiles 100, namely hockey pucks 100, are retained in the game projectile retaining cylinder 16, and the game projectile retaining cylinder 16 is retained and supported by the semicircular retaining wall 42. The base retainer member 25 cups the hockey pucks 100 and rests on the support base 45 of the first dispensing housing half 14A with the mouth 21 of the base retainer member 25 facing the angled slide wall 44 and the game projectile emission chute 46. The distal leg 35 of the actuating lever 22 passes through the aperture 27, and the most distal end of the distal leg 35 contacts the lower-most hockey puck 100. A striking implement 200, namely a hockey stick 200, is engaged with the engaging notch 37 on the first arm 36 as the case would be where a player would employ the actuating lever 22 to dispense a hockey puck 100.

As FIG. 7B illustrates, the player can continue the process of dispensing a hockey puck 100 by pressing the first arm 36 of the actuating lever 22 downwardly with the hockey stick 200 thereby causing a pivoting of the actuating lever 22. The distal leg 35 of the second arm 34 then drives the lower-most hockey puck 100 laterally through the mouth 21 of the base retaining member 25 whereupon it will pass by the angled slide wall 44 and drop into the game projectile emission chute 46. If necessary to allow the hockey puck 100 to leave the mouth 21 of the base retaining member 25, the actuating lever 22 can be pressed further whereupon the distal leg 35 of the second arm 34 will engage and lift the remaining hockey pucks 100 as FIG. 7B shows such that the lower-most hockey puck 100 will be better able to drop from the mouth 21 of the base retaining member 25.

Once the lower-most hockey puck 100 falls into the game projectile emission chute 46, it will drop on its edge onto the base plate 34 of the game projectile supply ramp 20. Since the hockey puck 100 is round, it will tend to roll down the game projectile supply ramp 20, out of the game projectile emission chute 46, and onto a surrounding ground surface. Once so dispensed from the game projectile dispensing device 10, the hockey puck 100 can be struck or otherwise manipulated by the player with the hockey stick 200. When one hockey puck 100 has been shot or otherwise disposed of, the player can readily dispense a second and further hockey pucks 100 by a simple operation of the actuating lever 22.

Advantageously, the player can control the direction in which the hockey puck 100 is dispensed from the game projectile dispensing device 10 by use of the control knob 18 to control the orientation of the game projectile dispensing ramp 20. Where the player seeks to have the hockey puck 100 roll from the game projectile emission chute 46 to the side of the first dispensing housing half 14A, he or she can rotate the control knob 18 counter-clockwise such that the game projectile dispensing ramp 20 will provide a ramp sloped toward the side of the first dispensing housing half 14A. Where the player seeks to have the hockey puck 100 roll from the game projectile emission chute 46 to the side of the second dispensing housing half 14B, he or she can rotate the control knob 18 clockwise until the game projectile dispensing ramp 20 provides a ramp sloped toward the side of the second dispensing housing half 14A.

It should be clear that, although the game projectile emission chute 46 is shown and described as a single passageway, it can be formed and/or considered to be two separate, opposed passageways. With this, as FIG. 2 shows, the game projectile emission chute 46 can be formed and described as a first game projectile emission chute 46A disposed in the first dispensing housing half 14A for enabling a game projectile to be dispensed from the first side of the dispensing housing 14 and as a second game projectile emission chute 46B disposed in the second dispensing housing half 14B for enabling a game projectile 100 to be dispensed from the second side of the dispensing housing 14.

Under this arrangement, the game projectile dispensing device 10 can accommodate players of left and right hand dominances. Furthermore, players of each hand dominance can practice forehand shots where, for example, the hockey puck 100 is dispensed from the side of the first dispensing housing half 14A and backhand shots where, for example, the hockey puck 100 is dispensed from the side of the second dispensing housing half 14B. A plurality of further advantages are derived from the ability of the game projectile retaining cylinder 16 to be removed and replaced relative to the dispensing housing 14. For example, a player can lift and carry the game projectile retaining cylinder 16 to retrieve a number of hockey pucks 100 that have been dispensed by the game projectile dispensing device 10 and shot or otherwise manipulated. In doing so, the player can drop a plurality of hockey pucks 100 into the upper end of the game projectile retaining cylinder 16 to create a stack of hockey pucks 100.

Advantageously, the base plate 29 of the base retainer member 25 will retain the stack of hockey pucks 100 securely within the game projectile retaining cylinder 16 until they are to be dispensed as previously described. In this regard, one will note that the retaining handle 24 is disposed to the same side of the game projectile retaining cylinder 16 as the open mouth 21 of the base retainer member 25 such that hockey pucks 100 will not tend to slide through the open mouth 21 inadvertently. Additionally, the game projectile retaining cylinder 16 can be removed to allow for storage, packaging, and transportation of the game projectile dispensing device 10. Still further, an entire stack of hockey pucks 100 or other game projectiles can be stored in and/or shipped with the game projectile retaining cylinder 16 and the game projectile dispensing device 10.

From the foregoing, it will be clear that the present invention has been shown and described with reference to certain preferred embodiments that merely exemplify the broader invention revealed herein. Certainly those skilled in the art can conceive of alternative embodiments. For instance, those with the major features of the invention in mind could craft embodiments that incorporate those major features while not incorporating all of the features included in the preferred embodiments.

With the foregoing in mind, the following claims are intended to define the scope of protection to be afforded the inventors, and the claims shall be deemed to include equivalent constructions insofar as they do not depart from the spirit and scope of the present invention. A plurality of the following claims express certain elements as a means for performing a specific function, at times without the recital of structure or material. As the law demands, these claims shall be construed to cover not only the corresponding structure and material expressly described in the specification but also equivalents thereof.

We claim as deserving the protection of Letters Patent:

1. A game projectile dispensing device for dispensing a game projectile onto an adjacent ground surface, the game projectile dispensing device comprising:

a dispensing housing with a first side and a second side;

a means for retaining at least one game projectile relative to the dispensing housing;

a first game projectile emission chute disposed in the first side of the dispensing housing for enabling a game projectile to be dispensed from the first side of the dispensing housing;

a second game projectile emission chute disposed in the second side of the dispensing housing for enabling a game projectile to be dispensed from the second side of the dispensing housing;

an actuating means for enabling a player to dispense a game projectile from the dispensing housing; and a selection means for enabling a player to select between emitting the game projectile from the first game projectile emission chute and emitting the game projectile from the second game projectile emission chute.

2. The game projectile dispensing device of claim 1 wherein the selection means comprises a game projectile supply ramp.

3. The game projectile dispensing device of claim 2 wherein the game projectile supply ramp is tiltable from a first orientation wherein the game projectile supply ramp provides a ramp sloped toward the first game projectile emission chute and a second orientation wherein the game projectile supply ramp provides a ramp sloped toward the second game projectile emission chute.

4. The game projectile dispensing device of claim 3 wherein the game projectile supply ramp has at least a first axle rod for pivotally supporting the game projectile supply ramp.

5. The game projectile dispensing device of claim 4 wherein the selection means comprises a control knob operably coupled to the first axle rod of the game projectile supply ramp whereby a player can rotate the control knob in a first rotational direction to cause the game projectile supply ramp to provide a ramp sloped toward the first game projectile emission chute and in a second rotational direction to cause the game projectile supply ramp to provide a ramp sloped toward the second game projectile emission chute.

6. The game projectile dispensing device of claim 1 wherein the actuating means comprises an actuating lever that is pivotable about a pivot axis.

7. The game projectile dispensing device of claim 6 wherein the actuating lever has a first arm for being engaged by a player and a second arm for engaging a game projectile and inducing the game projectile to be dispensed from the dispensing housing.

8. The game projectile dispensing device of claim 7 wherein the means for retaining at least one game projectile relative to the dispensing housing comprises a means for retaining a plurality of game projectiles in a stack.

9. The game projectile dispensing device of claim 8 wherein the second arm of the actuating lever is generally L-shaped with a proximal leg of the L disposed generally perpendicularly to the first arm of the actuating lever and a distal leg of the L disposed generally perpendicularly to the proximal leg and collinear with the first arm of the actuating lever.

10. The game projectile dispensing device of claim 9 wherein the distal leg of the second arm of the actuating lever is disposed adjacent to at least a lower-most game projectile in the stack of game projectiles when the actuating lever is in a non-actuated orientation whereby a player can press on the first arm of the actuating lever to pivot the actuating lever to induce the distal leg of the second arm of the actuating lever to drive the lower-most projectile from the stack of game projectiles to allow the lower-most game projectile to be dispensed from the dispensing housing.

11. The game projectile dispensing device of claim 10 wherein the selection means comprises a game projectile supply ramp, wherein the game projectile supply ramp is disposed below the means for retaining the plurality of game projectiles, and wherein the game projectile supply ramp is tiltable from a first orientation wherein the game projectile supply ramp provides a ramp sloped toward the first game projectile emission chute and a second orientation wherein the game projectile supply ramp provides a ramp sloped toward the second game projectile emission chute whereby, when driven from the stack of game projectiles, a game projectile will drop onto the game projectile supply ramp for being dispensed from either the first game projectile emission chute or the second game projectile emission chute.

12. The game projectile dispensing device of claim 1 wherein the means for retaining at least one game projectile relative to the dispensing housing comprises a game projectile retaining member with a body portion, a first end, a second end, and an open inner volume for retaining a plurality of game projectiles wherein the game projectile retaining member is removably and replaceably received relative to the dispensing housing.

13. The game projectile dispensing device of claim 12 wherein the game projectile retaining member has a base retainer member disposed at the first end thereof for preventing game projectiles from being inadvertently dislodged from within the open inner volume of the game projectile retaining member whereby the game projectile retaining member can be used in retrieving, retaining, storing, and dispensing game projectiles.

14. The game projectile dispensing device of claim 13 wherein the base retainer member has an open mouth for allowing the dispensing of game projectiles.

15. The game projectile dispensing device of claim 14 wherein the actuating means comprises an actuating lever that is pivotable about a pivot axis and wherein the base retainer has an aperture disposed opposite to the open mouth for allowing an entry and operation of the actuating lever.

16. The game projectile dispensing device of claim 13 further comprising a handle coupled to the body portion of the game projectile retaining member wherein the handle is disposed generally in line with the open mouth of the base retainer member.

17. A game projectile dispensing device for dispensing a game projectile onto an adjacent ground surface, the game projectile dispensing device comprising:

a dispensing housing;

a means for retaining at least one game projectile relative to the dispensing housing;

an actuating means for enabling a player to dispense a game projectile from the dispensing housing; and a selection means comprising a game projectile supply ramp with a first end and a second, opposite end for enabling a player to select between emitting the game projectile in a first direction or in a second direction opposite the first direction wherein the game projectile supply ramp is tiltable from a first orientation wherein the game projectile supply ramp provides a ramp sloped toward the first direction wherein the game projectile will be emitted from the first end of the game projectile supply ramp and a second orientation wherein the game projectile supply ramp provides a ramp sloped toward the second direction wherein the game projectile will be emitted from the second end of the game projectile supply ramp.

18. The game projectile dispensing device of claim 17 wherein the actuating means comprises an actuating lever that is pivotable about a pivot axis.

19. The game projectile dispensing device of claim 18 wherein the actuating lever has a first arm for being engaged by a player and a second arm for engaging a game projectile and inducing the game projectile to be dispensed from the dispensing housing.

20. The game projectile dispensing device of claim 19 wherein the means for retaining at least one game projectile relative to the dispensing housing comprises a means for retaining a plurality of game projectiles in a stack, wherein the second arm of the actuating lever is generally L-shaped with a proximal leg of the L disposed generally perpendicularly to the first arm of the actuating lever and a distal leg of the L disposed generally perpendicularly to the proximal leg and collinear with the first arm of the actuating lever, and wherein the distal leg of the second arm of the actuating lever is disposed adjacent to at least a lower-most game projectile in the stack of game projectiles when the actuating lever is in a non-actuated orientation whereby a player can press on the first arm of the actuating lever to pivot the actuating lever to induce the distal leg of the second arm of the actuating lever to drive the lower-most projectile from the stack of game projectiles to allow the lower-most game projectile to be dispensed from the dispensing housing.

21. A game projectile dispensing device for dispensing a game projectile onto an adjacent ground surface, the game projectile dispensing device comprising:

a dispensing housing with a first side and a second side;

a means for retaining a plurality of game projectiles in a stack relative to the dispensing housing;

a first game projectile emission chute disposed in the first side of the dispensing housing for enabling a game projectile to be dispensed from the first side of the dispensing housing;

a second game projectile emission chute disposed in the second side of the dispensing housing for enabling a game projectile to be dispensed from the second side of the dispensing housing;

an actuating lever for enabling a player to dispense a game projectile from the dispensing housing, wherein the actuating lever has a first arm for being engaged by a player and a second arm for engaging a game projectile and inducing the game projectile to be dispensed from the dispensing housing, wherein the actuating lever is pivotable about a pivot axis, wherein the second arm of the actuating lever is generally L-shaped with a proximal leg of the L disposed generally perpendicularly to the first arm of the actuating lever and a distal leg of the L disposed generally perpendicularly to the proximal leg and collinear with the first arm of the actuating lever, wherein the distal leg of the second arm of the actuating lever is disposed adjacent to at least a lower-most game projectile in the stack of game projectiles when the actuating lever is in a non-actuated orientation whereby a player can press on the first arm of the actuating lever to pivot the actuating lever to induce the distal leg of the second arm of the actuating lever to drive the lower-most projectile from the stack of game projectiles; and a game projectile supply ramp for enabling a player to select between emitting the game projectile from the first game projectile emission chute and emitting the game projectile from the second game projectile emission chute, wherein the game projectile supply ramp is tiltable from a first orientation wherein the game projectile supply ramp provides a ramp sloped toward the first game projectile emission chute and a second orientation wherein the game projectile supply ramp provides a ramp sloped toward the second game projectile emission chute, wherein the game projectile supply ramp is disposed below the means for retaining the plurality of game projectiles whereby, when driven from the stack of game projectiles, a game projectile will drop onto the game projectile supply ramp for being dispensed from either the first game projectile emission chute or the second game projectile emission chute.

22. The game projectile dispensing device of claim 21 wherein the means for retaining a plurality of game projectiles in a stack comprises a game projectile retaining member with a body portion, a first end, a second end, and an open inner volume for retaining a plurality of game projectiles, wherein the game projectile retaining member is removably and replaceably received relative to the dispensing housing, wherein the game projectile retaining member has a base retainer member disposed at the first end thereof for preventing game projectiles from being inadvertently dislodged from within the open inner volume of the game projectile retaining member whereby the game projectile retaining member can be used in retrieving, retaining, storing, and dispensing game projectiles, and wherein the base retainer member has an open mouth for allowing the dispensing of game projectiles and an aperture disposed opposite to the open mouth for allowing an entry and operation of the actuating lever.

* * * * *